US005935923A

United States Patent [19]

Gupta

[11] Patent Number: 5,935,923

[45] Date of Patent: Aug. 10, 1999

[54] PROCESS FOR PREPARING HIGH BULK DENSITY DETERGENT COMPOSITIONS

[75] Inventor: Anshu Mali Gupta, Amsterdam, Netherlands

[73] Assignee: Lever Brothers Company, Division of Conopco, Inc., New York, N.Y.

[21] Appl. No.: 08/925,452

[22] Filed: Sep. 8, 1997

[30] Foreign Application Priority Data

Sep. 10, 1996 [GB] United Kingdom ..... 9618877

[51] Int. Cl.[6] ..... C11D 11/00

[52] U.S. Cl. ..... 510/444; 510/351; 510/353; 510/355; 510/483; 264/117; 264/140

[58] Field of Search ..... 510/444, 351, 510/353, 355, 483; 264/140, 117

[56] References Cited

U.S. PATENT DOCUMENTS

| | | | |
|---|---|---|---|
| 4,261,850 | 4/1981 | Manders et al. | 510/453 |
| 5,066,425 | 11/1991 | Ofosu-Asante et al. | 510/536 |
| 5,152,932 | 10/1992 | Mueller et al. | 510/438 |
| 5,164,108 | 11/1992 | Appel et al. | 510/444 |
| 5,486,317 | 1/1996 | Dorset et al. | 510/444 |
| 5,516,448 | 5/1996 | Capeci et al. | 252/89.1 |
| 5,529,710 | 6/1996 | Van Dijk et al. | 510/444 |
| 5,663,136 | 9/1997 | Van Dijk et al. | 510/444 |
| 5,723,428 | 3/1998 | Boskamp et al. | 510/481 |

FOREIGN PATENT DOCUMENTS

| | | |
|---|---|---|
| 0071987 | 2/1983 | European Pat. Off. . |
| 0328190 | 8/1989 | European Pat. Off. . |
| 367 339 | 5/1990 | European Pat. Off. . |
| 0402112 | 12/1990 | European Pat. Off. . |
| 420 317 | 4/1991 | European Pat. Off. . |
| 0507402 | 10/1992 | European Pat. Off. . |
| 507 402 | 10/1992 | European Pat. Off. . |
| 508 543 | 10/1992 | European Pat. Off. . |
| 578 872 | 1/1994 | European Pat. Off. . |
| 618 289 | 10/1994 | European Pat. Off. . |
| 622 454 | 11/1994 | European Pat. Off. . |
| 637 628 | 2/1995 | European Pat. Off. . |
| 663 439 | 7/1995 | European Pat. Off. . |
| 688 862 | 12/1995 | European Pat. Off. . |
| 694 608 | 1/1996 | European Pat. Off. . |
| 771 864 | 5/1997 | European Pat. Off. . |
| 42 35 139 | 4/1994 | Germany . |
| 2 166 452 | 5/1986 | United Kingdom . |
| 9323520 | 11/1993 | WIPO . |
| 95/02036 | 1/1995 | WIPO . |
| 97/10321 | 3/1997 | WIPO . |

OTHER PUBLICATIONS

Derwent abstract of JP 6 314 3933 dated Jun. 16, 1988.
Derwent abstract of JP 0 802 7493 dated Jan. 30, 1996.

*Primary Examiner*—Lorna M. Douyon
*Attorney, Agent, or Firm*—Rimma Mitelman

[57] ABSTRACT

A process for preparation of a granular detergent composition which process comprises the steps of (i) forming a liquid feedstock comprising a liquid binder and a structurant;

(ii) dosing the liquid feedstock and a solid component into a high-speed mixer/densifier, to form a granular detergent material and forming or introducing further structurant in the high-speed mixer/densifier;

(iii) subsequently treating the granular detergent material in a moderate-speed granulator/densifier, whereby it is brought into or maintained in a deformable state; and (iv) drying and/or cooling the product of step (iii).

11 Claims, No Drawings

PROCESS FOR PREPARING HIGH BULK DENSITY DETERGENT COMPOSITIONS

FIELD OF THE INVENTION

The present invention relates to a process for preparing a granular detergent composition or component having a high bulk density and good powder properties. More in particular, it relates to a process for the continuous preparation of such detergent compositions. Furthermore, it relates to a granular detergent composition obtainable by the process of the present invention.

BACKGROUND OF THE INVENTION

Recently there has been considerable interest within the detergents industry in the production of detergent powders having a relatively high bulk density, for example 550 g/l and above.

Generally speaking, there are two main types of processes by which detergent powders can be prepared. The first type of process involves spray-drying and aqueous detergent slurry in a spray-drying tower. In the second type of process the various components are dry-mixed and optionally agglomerated with liquids, e.g. nonionics. The latter kind of process is more suited to the production of powders having a relatively high bulk density. That is primarily because the chemical composition of the slurry used in the spray drying process markedly affects the bulk density of the granular product. This bulk density can only be significantly increased by increasing the content of relatively dense sodium sulphate. However, sodium sulphate does not contribute to detergency, so that the overall performance of the powder in the wash is thereby reduced.

One dry-mix process suitable for production of relatively high density products is described in European Patent Specification EP-A-0 420 317. This involves reacting a liquid acid precursor of an anionic surfactant with an alkaline inorganic material in a high-speed mixer/densifier, treating the material in a moderate-speed granulator/densifier, and finally drying and/or cooling the material. The heat of the neutralization reaction between the acid surfactant precursor and the alkaline material is used to bring the starting material into a deformable state, and results in densification of the detergent composition.

In the case of powders which also contain a nonionic surfactant, it is possible to "structure" the (liquid) nonionic by reacting the acid precursor and the alkaline material in situ i.e. by dissolving the precursor in the nonionic and then adding the alkaline material to the solution in the first stage of the process. The same structuring can be achieved by in situ formation of a soap during the first stage, i.e. substituting a fatty acid for the anionic acid precursor so that the soap is formed by a saponification reaction during that stage.

One drawback of such a process is the poor i.e. broad particle size distribution of the resultant powder. This can be conveniently expressed by two measures:

(a) The total amounts of fines (<180 microns) and coarse (>1400 microns) in the product.

(b) The n value of the Rosin Rammler distribution. This is calculated by fitting the particle size distribution to an n-power distribution according to the following formula:

$$R = 100 * \mathrm{Exp}\left\{-\left(\frac{D}{D_r}\right)^n\right\}$$

where R is the cumulative percentage of powder above a certain size D. $D_r$ is the average granule size and n is a measure of the particle size distribution. $D_r$ and n are the Rosin Rammler fits to a measured particle size distribution.

A high n value means narrow particle size distribution and low values mean a broad particle size distribution.

Typically powders produced by the aforementioned kind of granulation process have a total coarse and fines levels of around 20%. This usually translates into n values around 1.5. This is a problem in processing, since fines need to be recycled and coarse granules may need milling. Further since between the range 180–1400 microns, the particle size distribution is broad, the powders may have a negative impact on consumer product perception. Particularly excessive levels of fines can lead to poor dispersion/dissolution characteristics in use. This is due to a tendency for the powder bed to gel on contact with water in the wash, which in turn subtracts from the total wash performance. It also leaves undesirable residues and causes negative interaction with sensitive fabrics.

SUMMARY OF THE INVENTION

This disadvantage has now been overcome by the present invention which involves incorporating a structurant for the nonionic, partly before and partly during the first stage of the process. The structurant may be added as such or formed in situ as referred to above, according to its type.

Thus, in a first aspect, the present invention provides a process for preparation of a granular detergent composition which process comprises the steps of (i) forming a liquid feedstock comprising a liquid binder and a structurant;

(ii) dosing the liquid feedstock and a solid component into a high-speed mixer/densifier, to form a granular detergent material and forming or introducing further structurant in the high-speed mixer/densifier;

(iii) subsequently treating the granular detergent material in a moderate-speed granulator/densifier, whereby it is brought into or maintained in a deformable state; and (iv) drying and/or cooling the product of step (iii).

In a second aspect, the invention provides a granular detergent composition or component prepared by this process.

The structurant may be incorporated with the feedstock during step (i) as dosed structurant per se and/or the structurant may be formed in situ in the feedstock during step (i). It is also possible to dose additional structurant per se into the high-speed mixer/densifier during step (ii) and/or form the additional structurant in situ in the high-speed mixer/densifier. The structurant formed or introduced in step (ii) may be the same as or different from the structurant formed or introduced in step (i).

As used herein, the term "structurant" means a chemical component that helps "structure" the liquid in the powder granules thus rendering it effectively immobile. The aim here is to prevent the liquid phase from leaking. A structurant works by enhancing the viscosity of the liquid phase. This could include transformation of phases, i.e. from liquid to liquid crystalline. Or this could include solidification. Examples of structurants include polymers, crystallizing agents, organic soap molecules, solids etc. . . .

DETAILED DESCRIPTION OF THE PREFERRED EMBODIMENTS

Preferably, step (i) is performed in an in-line dynamic mixer located within a recirculation loop. Preferably also, a heat exchanger is located within this loop to remove the heat of reaction of any in situ formation of structurant. Here, the aim is to ensure completion of reaction and homogeneity of the reaction product within the liquid feedstock which is fed with dosing uniformity of components from the dynamic mixer/recirculation loop to the high-speed mixer/densifier used in step (ii).

Preferably, the Newtonian viscosity of the liquid feedstock fed to step (ii) is from 0.1 to 6 Pa.s at 60° C.

The residence time in the high-speed mixer/densifier during step (ii) is preferably about from 5 to 30 seconds. Moreover, the residence time in the moderate-speed mixer/densifier during step (iii) is preferably about from 1 to 10 minutes. The process is preferably performed as a continuous process.

Steps (ii) and (iii) may respectively be effected using a high-speed mixer/densifier machine followed by a separate moderate-speed granulator/densifier machine. Alternatively, steps (ii) and (iii) could be effected using a single machine operated at two speeds, first at high speed for mixing/densification and then at moderate speed for granulation densification. Suitable machines include mixers of the Fukae® FS-G series; Diosna® V series ex Dierks & Sohne, Germany; Pharma Matrix® Fielder Ltd; England; Fuji® VG-C series ex Fuji Sangyo Co., Japan; the Roto® ex Zanchetta & Co. srl, Italy and the Schugi® Flexomix granulator.

Granular detergent compositions according to the present invention may be in the form of complete products ready for sale to the consumer. Alternatively, they may be formulated as base powders to which other ingredients are post-dosed. In any event such compositions preferably have a bulk density of 550 g/l, more preferably at least 650 g/l.

The structurant may be added at each relevant stage in its final form. Such a structurant may for example be of a polymer type, such as PVA, PEG, PVP, polyacrylates etc. The total amount of polymer (on dry polymer basis) in the finished product is from 0.5%, 1% or 2% to 5%. Of this the weight ratio of that amount incorporated in the feedstock during step (i) is 5% to 85%. The rest being introduced in step (ii). Preferably the amount in step (i) is between 20% to 60%, more preferably between 30% and 50%.

As mentioned above, some of the structurant may be formed in situ at each relevant stage. In that case, a first reactant to form the structurant may be incorporated in the feedstock during step (i). Then, a second reactant may be partially dosed during step (i) and partially, dosed during step (ii). The amount of the first reactant should be sufficient to react with all of the second reactant dosed during step (i) and the amount of the second reactant dosed during step (ii) which it is desired to react with the first reactant (it may be required to leave some of the second reactant unreacted to fulfil another function in the final product, e.g. sodium carbonate as a builder). Here "final product" means the granules produced at the end of step (iv).

One example of a structurant formed in situ is an anionic surfactant formed by dissolving an acid precursor of that surfactant in the nonionic during step (i) and then dosing an alkaline inorganic material, partly during step (i) and partly during step (ii).

In principle, any alkaline inorganic material can be used. However, solid water-soluble alkaline inorganic materials are preferred. A preferred material is sodium carbonate, alone or in combination with one or more other water-soluble inorganic materials, for example, sodium bicarbonate or silicate. As alluded to above, sodium carbonate can provide the necessary alkalinity for the wash process, but it can additionally serve as a detergency builder. In this case the invention may be advantageously used for the preparation of detergent powders in which sodium carbonate is the sole or principal builder. Then, substantially more carbonate will be present than required for the neutralization reaction with the acid anionic surfactant precursor.

The liquid acid precursor of an anionic surfactant may be selected from linear alkyl benzene sulphonic acids, alpha-olefin sulphonic acids, internal olefin sulphonic acids, fatty acid ester sulphonic acids and combinations thereof. The process of the invention is especially useful for producing compositions comprising alkyl benzene sulphonates by reaction of the corresponding alkyl benzene sulphonic acid, for instance Dobanoic acid ex Shell.

Another preferred class of anionic surfactants are primary or secondary alkyl sulphates. Linear or branched primary alkyl sulphates having 10 to 15 carbon atoms are particularly preferred. These surfactants can be obtained by sulphatation of the corresponding primary or secondary alcohols, followed by neutralization. Because the acid precursors of alkyl sulphates are chemically unstable, they are not commercially available and they have to be neutralized as quickly as possible after their manufacture. The process of the present invention is especially suitable for incorporating alkyl sulphate surfactants into detergent powders because it involves a very efficient first mixing step wherein the acid surfactant precursor and the solid alkaline substance are brought into contact with one another. In this first step a quick and efficient neutralization reaction is effected whereby the decomposition of the alkyl sulphate acid is successfully kept at a minimum.

Another kind of structurant which may be formed in situ is a soap, formed by dissolving a fatty acid in the liquid binder and then dosing an alkali metal hydroxide, e.g. sodium or potassium hydroxide, partly during step (i) and partly during step (ii).

The total amount of fatty acid used during steps (i) and (ii) preferably comprises sufficient to form from 0.5% to 10% by weight of the soap based upon the weight of the total composition obtained at the end of step (iv), more preferably from 2% to 6%. The weight ratio of the alkali metal hydroxide dosed during step (ii) relative to that dosed during step (i) is preferably from 1.5:1 to 3:1, more preferably from 2:1 to 3:1 and especially from 2.5:1 to 3:1. In any event, the preferred degree of pre-saponification during step (i) is from 12 to 35 mole %, more especially from 20 to 30 mole %.

The liquid binder preferably comprises liquid nonionic surfactant and/or other liquid components.

Any such nonionic surfactant may comprise any one or more liquid nonionics selected from primary and secondary alcohol ethoxylates, especially $C_8$–$C_{20}$ aliphatic alcohols ethoxylated with an average of from 1 to 20 moles ethylene oxide per mole of alcohol, and more especially the $C_{10}$–$C_{15}$ primary and secondary aliphatic alcohols ethoxylated with an average of from 1 to 10 moles of ethylene oxide per mole of alcohol. Non-ethoxylated nonionic surfactants include alkylpolyglycosides, glycerol monoethers, and polyhydroxyamides (glucamide).

The total amount of nonionic of the liquid binder in which the structurant is dissolved or formed in situ is from 10 to 50% by weight of the total composition formed at the end of step (iv), more especially from 15% to 35%.

Detergent compositions of the invention may contain, in addition to any nonionic surfactant dosed in step (ii) and any structurant dosed during steps (i) and/or (ii) formed in situ, which itself is a surfactant, one or more other detergent-active compounds (surfactants) which may be chosen from soap and non-soap anionic cationic, nonionic, amphoteric and zwitterionic detergent-active compounds, and mixtures thereof. These may be dosed at any appropriate stage before or during steps (i)–(iii) or post-dosed after step (iii).

In general, any surfactant which is a solid will form part of the solid component and will be dosed during step (ii), unless it is a structurant in which case it will be dosed during step (i) or during steps (ii) and (iii) or correspondingly formed in situ. Any other solid materials, for example detergency builder will preferably be dosed during step (ii) and/or will be post-dosed after step (iv), as appropriate. Since the process of the present invention provides a product which has reactive humidity, percarbonate bleaches can be post-dosed.

Turning again to surfactants, many suitable detergent-active compounds are available and are fully described in the literature, for example, in "Surface-Active Agents and Detergents", Volumes I and II, by Schwartz, Perry and Berch. The preferred detergent-active compounds that can be used are soaps and synthetic non-soap anionic and nonionic compounds.

Suitable anionic surfactants are well-known to those skilled in the art. Examples include alkylbenzene sulphonates, particularly linear alkylbenzene sulphonates having an alkyl chain length of C8–C15; primary and secondary alkyl sulphates, particularly C12–C15 primary alkyl sulphates; alkyl ether sulphates; olefin sulphonates; alkyl xylene sulphonates; dialkyl sulphosuccinates; and fatty acid ester sulphonates. Sodium salts are generally preferred.

Suitable nonionic surfactants include those recited above.

Compositions according to the present invention may also contain, in addition to the detergent-active compounds, a detergency builder and optionally bleaching components and other active ingredients to enhance performance and properties. These may also be dosed at an appropriate time during steps (i)–(iv) or post-dosed.

The total amount of all surfactant present in the detergent composition is suitably from 10 to 90 wt % although amounts outside this range may be employed as desired.

The detergent compositions of the invention generally also contain a detergency builder. The total amount of detergency builder in the compositions is suitably from 10 to 80 wt %, preferably from 15 to 60 wt %. The builder may be present in an adjunct with other components or, if desired, separate builder particles containing one or more builder materials may be employed.

Inorganic builders that may be present include sodium carbonate, if desired in combination with a crystallisation seed for calcium carbonate as disclosed in GB-A-1 437 950. As mentioned above, such sodium carbonate may be the residue of an inorganic alkaline neutralising agent used to form an anionic structurant in situ. Other suitable builders include crystalline and amorphous aluminosilicates, for example zeolites as disclosed in GB-A-1 473 201; amorphous aluminosilicates as disclosed in GB-A-1 473 202; and mixed crystalline/amorphous aluminosilicates as disclosed in GB 1 470 250; and layered silicates as disclosed in EP-B-164 514. Inorganic phosphate builders, for example, sodium, orthophosphate, pyrophosphate and tripolyphosphate, may also be present, but on environmental grounds those may no longer be preferred in certain geographical regions.

Aluminosilicates, whether used as layering agents and/or incorporated in the bulk of the particles may suitably be present in a total amount of from 10 to 60 wt % and preferably an amount of from 15 to 50 wt %. The zeolite used in most commercial particulate detergent compositions is zeolite A. Advantageously, however, maximum aluminium zeolite P (zeolite MAP) described and claimed in EP-A-384 070 may be used. Zeolite MAP is an alkali metal aluminosilicated of the P type having a silicon to aluminium ratio not exceeding 1.33, preferably not exceeding 1.15, and more preferably not exceeding 1.07.

Organic builders that may be present include polycarboxylate polymers such as polyacrylates, acrylic/maleic copolymers, and acrylic phosphinates; monomeric polycarboxylates such as citrates, gluconates, oxydisuccinates, glycerol mono-, di- and trisuccinates, carboxymethyloxysuccinates, carboxymethyloxymalonates, dipicolinates, hydroxyethyliminodiacetates, aminopolycarboxylates such as nitrilotriacetates (NTA), ethylenediaminetetraacetate (EDTA) and iminodiacetates, alkyl- and alkenylmalonates and succinates; and sulphonated fatty acid salts. A copolymer of maleic acid, acrylic acid and vinyl acetate is especially preferred as it is biodegradable and thus environmentally desirable. This list is not intended to be exhaustive.

Especially preferred organic builders are citrates, suitably used in amounts of from 5 to 30 wt %, preferably from 10 to 25 wt %; and acrylic polymers, more especially acrylic/maleic copolymers, suitably used in amounts of from 0.5 to 15 wt %, preferably from 1 to 10 wt %. The builder is preferably present in alkali metal salt, especially sodium salt, form.

Suitably the builder system comprises a crystalline layered silicate, for example, SKS-6 ex Hoechst, a zeolite, for example, zeolite A and optionally an alkali metal citrate.

Detergent compositions according to the invention may also contain a bleach system, desirably a peroxy bleach compound, for example, an inorganic persalt or organic peroxyacid, capable of yielding hydrogen peroxide in aqueous solution. The peroxy bleach compound may be used in conjunction with a bleach activator (bleach precursor) to improve bleaching action at low wash temperatures. An especially preferred bleach system comprises a peroxy bleach compound (preferably sodium percarbonate optionally together with a bleach activator), and a transition metal bleach catalyst as described and claimed in EP 458 397A and EP-A-509 787.

Powder flow may be improved by the incorporation of a small amount of an additional powder structurant, for example, a fatty acid (or fatty acid soap), a sugar, an acrylate or acrylate/maleate polymer, or sodium silicate which is suitably present in an amount of from 1 to 5 wt %.

The materials that may be present in detergent compositions of the invention include sodium silicate; corrosion inhibitors including silicates; antiredeposition agents such as cellulosic polymers; fluorescers; inorganic salts such as sodium sulphate, lather control agents or lather boosters as appropriate; proteolytic and lipolytic enzymes; dyes; coloured speckles; perfumes; foam controllers; and fabric softening compounds. This list is not intended to be exhaustive.

In step (ii) of the process, solid components of the feedstock are very thoroughly mixed with the liquid components by means of a high-speed mixer/densifier. Such a mixer provides a high energy stirring input and achieves thorough mixing in a very short time.

As high-speed mixer/densifier we advantageously used the Lödige (Trade Mark) CB 30 Recycler. This apparatus essentially consists of a large, static hollow cylinder having a diameter of about 30 cm which is horizontally placed. In the middle, it has a rotating shaft with several different types of blades mounted thereon. It can be rotated at speeds between 100 and 2500 rpm, dependent on the degree of densification and the particle size desired. The blades on the shaft provide a thorough mixing action of the solids and the liquids which may be admixed at this stage. The mean residence time is somewhat dependent on the rotational speed of the shaft, the position of the blades and the weir at the exit opening.

Other types of high-speed mixers/densifiers having a comparable effect on detergent powders can also be contemplated. For instance, a Shugi (Trade Mark) Granulator or a Drais (Trade Mark) K-TTP 80 may be used.

In step (ii), the components of the feedstock are thoroughly mixed in a high-speed mixer/densifier for a relatively short time of about 5–30 seconds, preferably under conditions whereby the starting material is brought into, or maintained in, a deformable state, to be defined hereafter.

After step (ii) the detergent material still possesses a considerable porosity. Instead of choosing a longer residence time in the high-speed mixer/densifier to obtain a further bulk density increase, the process of the present invention provides a second processing step in which the detergent material is treated for 1–10 minutes, preferably for 2–5 minutes, in a moderate-speed granulator/densifier. During this second processing step, the conditions are such that the powder is brought into, or maintained in, a deformable state. As a consequence, the particle porosity will be further reduced. The main differences with the first step reside in the lower mixing speed and the longer residence time of 1–10 minutes, and the necessity for the powder to be deformable.

Step (iii) can be successfully carried out in a Lödige (Trade Mark) KM 300 mixer, also referred to as Lödige Ploughshare. This apparatus essentially consists of a hollow static cylinder having a rotating shaft in the middle. On this shaft various plough-shaped blades are mounted. It can be rotated at a speed of 40–160 rpm. Optionally, one or more high-speed cutters can be used to prevent excessive agglomeration. Another suitable machine for this step is, for example the Drais (Trade Mark) K-T 160.

For use, handling and storage, the densified detergent powder must obviously no longer be in a deformable state. Therefore, in step (iv) the densified powder is dried and/or cooled. This step can be carried out in a known manner, for instance in a fluid bed apparatus (drying, cooling) or in an airlift (cooling). It is advantageous if the powder needs a cooling step only, because the required equipment is relatively simple and more economical.

Essential for the second step and preferred for the first step of the process is the deformable state into which the detergent powder must be brought in order to get optimal densification. The high-speed mixer/densifier and/or the moderate speed granulator/densifier are then able to effectively deform the particulate material in such a way that the particle porosity is considerably reduced or kept at a low level, and consequently the bulk density is increased.

The invention will now be explained in more detail by way of the following non-limiting examples.

EXAMPLES

The following base formulation was made:

| | |
|---|---|
| Zeolite A24 (ex Crosfiled) | 69.6% |
| Synperionic A 7EO (ex ICI) | 24.6% |
| Soap | 4.7% |
| Rest | 1% |

The Soap was formed by reaction of Fatty acid (Pristeren 4916) with a 50% caustic solution. Nonionic and Fatty acid premixture was made first. This was neutralized with the 50% caustic solution. This mixture was then fed to the processing stream, which consists out of the following patented series: Recycler (CB30 Lodiger), Ploughshare (KM300) and Niro FluidBed. The zeolite was fed directly to the Recycler. The binder (consisting of nonionic, fatty acid) was optionally preneutralized before bringing to the Recycler. This preneutralization step is undertaken in a suitable mixer, here a dynamic mixer (in line continuous homogeniser). To ensure the homogeneity of the reaction mixture it was partially recirculated in a loop consisting of a series of static mixers.

The temperature of the mixture was 65° C. The recirculation in the loop varied between 30–60 $dm^3$/min. The following levels of preneutralization were achieved:

| Example A (Reference) | Example 1 | Example 2 | Example 3 | |
|---|---|---|---|---|
| 0% | 11.7% | 26.5% | 35% | level of preneutralization |
| | | | | Feed to Dynamic Mixture |
| 425 | 425 | 425 | 425 | Synperonic A 7EO |
| 75 | 75 | 75 | 75 | Pristerene 4916 |
| 0 | 2.7 | 6.1 | 8 | 50% caustic solution |
| | | | | Feed to Recycler |
| 500 | 502.7 | 506.1 | 508 | Binder from Dynamic Mixture |
| 1000 | 1000 | 1000 | 1000 | Zeolite A24 |
| 23 | 20.3 | 16.9 | 15 | 50% caustic |

All rates above in kg/hr. The CB30 was run at a rpm of 1500.

The powders were collected after the Recycler, Ploughshare and Fluidbed. The physical properties of the powders were established. Particle size distribution were characterised by several measures. Particles were sieved in the fraction 0, 180, 250, 355, 500, 710, 1000, 1400, 2000 microns. The distribution was fitted with to a Rosin Rammler model. The Rrd values indicates the average particle size of the distribution and Rrn value indicates the average spread. Further the fraction of powder less than 180 $\mu$m shall be termed fines and greater than 1400 $\mu$m considered as coarse. The BD of the particles was measured in a standard way as was DFR. The results below illustrate the advantage of Example 2 over Examples A, 1 and 3.

| Example A (Reference) | Example 1 | Example 2 | Example 3 | |
|---|---|---|---|---|
| 0% | 11.7% | 26.5% | 35% | level of preneutralization |
| 107 | 111 | 126 | 107 | DFR (ex Ploughshare) |
| 845 | 917 | 828 | 788 | BD (gms/1) (ex Ploughshare) |

-continued

| Example A (Reference) | Example 1 | Example 2 | Example 3 | |
|---|---|---|---|---|
| 474 | 531 | 655 | 509 | RRd μm (ex Ploughshare) |
| 1.57 | 1.45 | 3.44 | 1.76 | RRn (ex Ploughshare) |
| 18.8 | 17.4 | 0.7 | 11.4 | % less than 180 μm |
| 0.6 | 2.7 | 3.3 | 3.0 | % greater than 1400 μm |

These powders are then further post dosed as required to form complete detergent formulation.

In the light of this disclosure, modifications of the described examples, as well as other examples, all within the scope of the present invention as defined by the appended claims will now become apparent to persons skilled in the art.

I claim:

1. A process for preparation of a granular detergent composition which process comprises the steps of (i) forming a liquid feedstock comprising a liquid binder containing (a) a nonionic surfactant, (b) a structurant, and (c) an acid precursor selected from the group consisting of a fatty acid precursor of a soap and an acid precursor of an anionic surfactant;

(ii) dosing the liquid feedstock and a solid component into a high-speed mixer/densifier to form a granular detergent material and forming further structurant in situ in the high-speed mixer/densifier by reaction of the acid precursor with an alkali metal hydroxide solution;

(iii) subsequently treating the granular detergent material in a moderate-speed granulator/densifier, whereby it is brought into or maintained in a deformable state; and (iv) drying and/or cooling the product of step (iii).

2. A process according to claim 1, wherein the structurant formed in step (ii) is the same as the structurant in step (i).

3. The process according to claim 1 wherein the structurant formed in step (ii) is different from the structurant in step (i).

4. The process according to claim 1 wherein the structurant in the liquid feedstock is formed in situ in step (i) by reaction of an acid precursor with an alkaline inorganic material, the acid precursor being selected from the group consisting of a fatty acid precursor of a soap and an acid precursor of an anionic surfactant.

5. The process of claim 4 wherein the alkaline inorganic material is an alkali metal hydroxide solution.

6. The process according to claim 4, wherein a soap structurant is formed in step (ii) which is the same soap structurant as formed in step (i) and the alkaline inorganic material is an alkali metal hydroxide.

7. The process according to claim 6, wherein the total amount of fatty acid used before and during steps (i) and (ii) is sufficient to form from 0.5% to 10% by weight of soap based upon the weight of the total composition obtained at the end of step (iv).

8. The process according to claim 6, wherein the weight ratio of the alkali metal hydroxide dosed during step (ii) relative to the alkali metal hydroxide dosed during step (i) is from 1.5:1 to 3:1.

9. A process according to claim 1, wherein 12 to 35 mole % of the total soap structurant is formed in step (i).

10. The process according to claim 1, wherein step (i) is performed in an in-line dynamic mixer located within a recirculation loop.

11. The process according to claim 10, wherein the recirculation loop has a heat exchanger located therein.

* * * * *